US006443506B1

(12) United States Patent
Su

(10) Patent No.: US 6,443,506 B1
(45) Date of Patent: Sep. 3, 2002

(54) DOOR LOCK SET OPTIONALLY SATISFYING EITHER LEFT-SIDE LATCH OR RIGHT-SIDE LATCH IN A LARGE ROTATING ANGLE

(76) Inventor: Frank Su, No. 26, Lane 143, Hsin-Sheng S. Road, Sec. 1, Taipei (TW)

( * ) Notice: Subject to any disclaimer, the term of this patent is extended or adjusted under 35 U.S.C. 154(b) by 86 days.

(21) Appl. No.: 09/745,514

(22) Filed: Dec. 20, 2000

Related U.S. Application Data

(63) Continuation-in-part of application No. 09/667,640, filed on Sep. 21, 2000.

(51) Int. Cl.[7] ..... E05B 15/00; E05B 15/10; E05B 17/00

(52) U.S. Cl. ..... 292/244; 70/462

(58) Field of Search ..... 292/244; 70/461, 70/462, 107

(56) References Cited

U.S. PATENT DOCUMENTS

| | | | | | |
|---|---|---|---|---|---|
| 3,390,558 | A | * | 7/1968 | Tornoe et al. | 70/107 |
| 4,809,526 | A | * | 3/1989 | Shen | 70/107 |
| 4,864,835 | A | * | 9/1989 | Wartian | 70/107 |
| 4,995,248 | A | * | 2/1991 | Liu | 70/107 |
| 5,077,992 | A | * | 1/1992 | Su | 70/107 |

FOREIGN PATENT DOCUMENTS

| | | | | |
|---|---|---|---|---|
| DE | 3627634 A1 | * | 2/1988 | |
| FR | 2493896 | * | 5/1982 | 70/462 |

* cited by examiner

*Primary Examiner*—Anthony Knight
*Assistant Examiner*—John B. Walsh

(57) ABSTRACT

A door lock set including: a housing fixed on a door; an upper cam rotatably mounted on an upper portion of the housing and operatively retracting an upper latch by a thumbturn knob; a lower cam rotatably mounted on a lower portion of the housing and operatively retracting a lower latch by rotating a door knob secured to a spindle of the lower cam; a linking device having an upper linking plate pivotally secured to the upper cam, a first linking rod and a second linking rod respectively upwardly pivotally secured to the upper linking plate and respectively downwardly pivotally secured to the lower cam, whereby the spindle can be rotated in a large angle for rotating the lower cam for retracting the lower latch and for synchronously biasing the upper cam for retracting the upper latch for opening the door, thereby being suitable for a door-knob type lock set; and the linking device may be optionally disposed on a right side portion of the upper cam for retracting the latch as provided on a right side of the door; or the linking device may be optionally disposed on a left side portion of the upper cam for retracting the latch as provided on a left side of the door.

1 Claim, 8 Drawing Sheets

DOOR LOCK SET OPTIONALLY SATISFYING EITHER LEFT-SIDE LATCH OR RIGHT-SIDE LATCH IN A LARGE ROTATING ANGLE

This application is a continuation-in-part (C-I-P) of U.S. Ser. No. 09/667,640 filed on Sep. 21, 2000, which is now defined as "prior application".

BACKGROUND OF THE INVENTION

The prior application (U.S. Ser. No. 09/667,640) as shown in FIG. 1 disclosed a door lock set including: a housing 1; an upper cam 2 operatively retracting an upper latch 3; a first linking rod 4 having an upper pin 41 slidably engaging in a left arcuate slot portion 22 of the arcuate slot 21 formed in the upper cam and a lower pin 42 slidably engaging with a slot 621 in a left lug 62 of a lower cam 6 having a spindle 61 rotatably mounted in a holding plate 60 as cushioned by a coiled spring 64; a second linking rod 5 having an upper pin 51 slidably engaging in a right arcuate slot portion 23 of the arcuate slot 21 and a lower pin 52 slidably engaging with a slot 631 in a right lug 63 of the lower cam 6; with the lower cam 6 operatively retracting a lower latch 7.

The prior application is especially suitable for use in a lever handle lock set having a small rotating angle when rotating either spindle (20 or 61) of the cam (2 or 6), not suitable for a door-knob type lock set, which will be explained hereinafter.

As shown in FIG. 2, a conventional door-knob type lock set includes: a door knob K which is rotated either clockwise R1 or counterclockwise R2 to allow either shoulder projection S1 or S2 formed on the knob spindle S to rearwardly push either lug L1 or L2 formed on a rear end portion of the latch bolt B for retracting the latch bolt B for opening a door. The door knob K (namely the spindle S) should be rotated in a wide or large angle in order to obtain an enough stroke for retracting the latch bolt B for opening the door.

Inferentially, if the prior application (U.S. Ser. No. 09/667,640 as illustrated in FIG. 1) is adapted for use as a door-knob type lock set as shown in FIG. 2, it will be described as follows:

When the knob K is rotated in an angle larger than a biasing angle A1 as shown in dotted line of FIG. 1, the linking rod 4 will be obstructed by the spindle 20 of the upper cam 2. Since a door knob K will require a larger or wider rotating angle A2 such as shown in phantom line of FIG. 1, the prior application is therefore not suitable for use in a door-knob type lock set because the two linking rods 4, 5 will be easily obstructed or retarded by the spindle 20 of the cam 2.

Therefore, the present inventor has found this drawback of the prior application and invented the present continuation-in-part for a larger rotating angle for a door-knob type lock set.

SUMMARY OF THE INVENTION

The object of the present invention is to provide a door lock set including: a housing fixed on a door; an upper cam rotatably mounted on an upper portion of the housing and operatively retracting an upper latch by a thumbturn knob; a lower cam rotatably mounted on a lower portion of the housing and operatively retracting a lower latch by rotating a door knob secured to a spindle of the lower cam; a linking device having an upper linking plate pivotally secured to the upper cam, a first linking rod and a second linking rod respectively upwardly pivotally secured to the upper linking plate and respectively downwardly pivotally secured to the lower cam, whereby the spindle can be rotated in a large angle for rotating the lower cam for retracting the lower latch and for synchronously biasing the upper cam for retracting the upper latch for opening the door, thereby being suitable for a door-knob type lock set; and the linking device may be optionally disposed on a right side portion of the upper cam for retracting the latch as provided on a right side of the door; or the linking device may be optionally disposed on a left side portion of the upper cam for retracting the latch as provided on a left side of the door.

DETAILED DESCRIPTION

Figure 1:
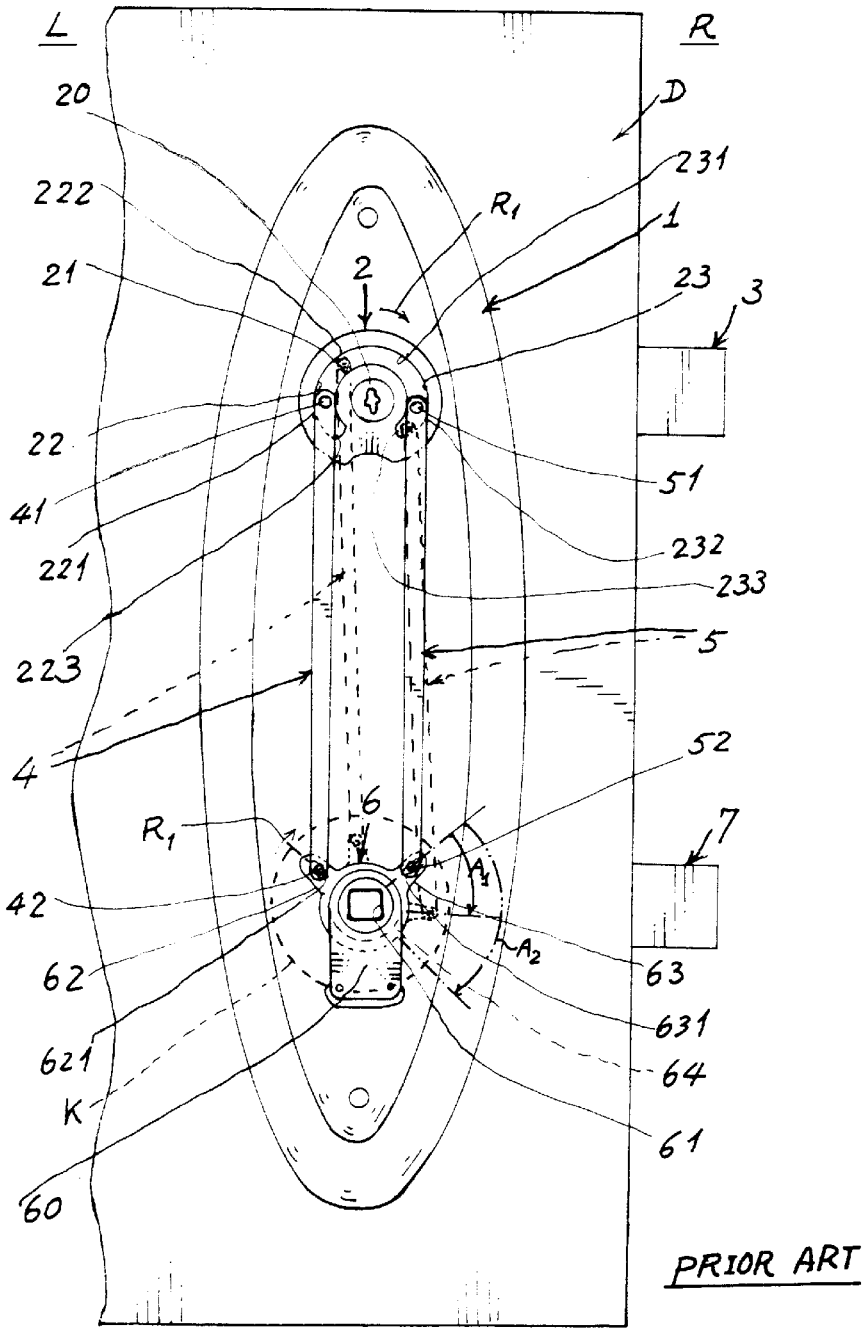
PRIOR ART Fig. 1
FIG. 1 shows a door lock set of the prior application.
Figure 2:
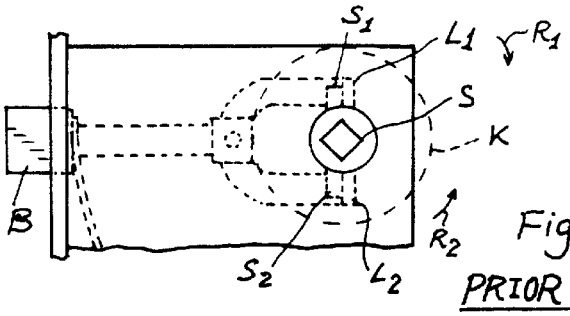
Fig. 2 PRIOR ART
FIG. 2 shows a conventional door-knob type lock set.
Figure 3:
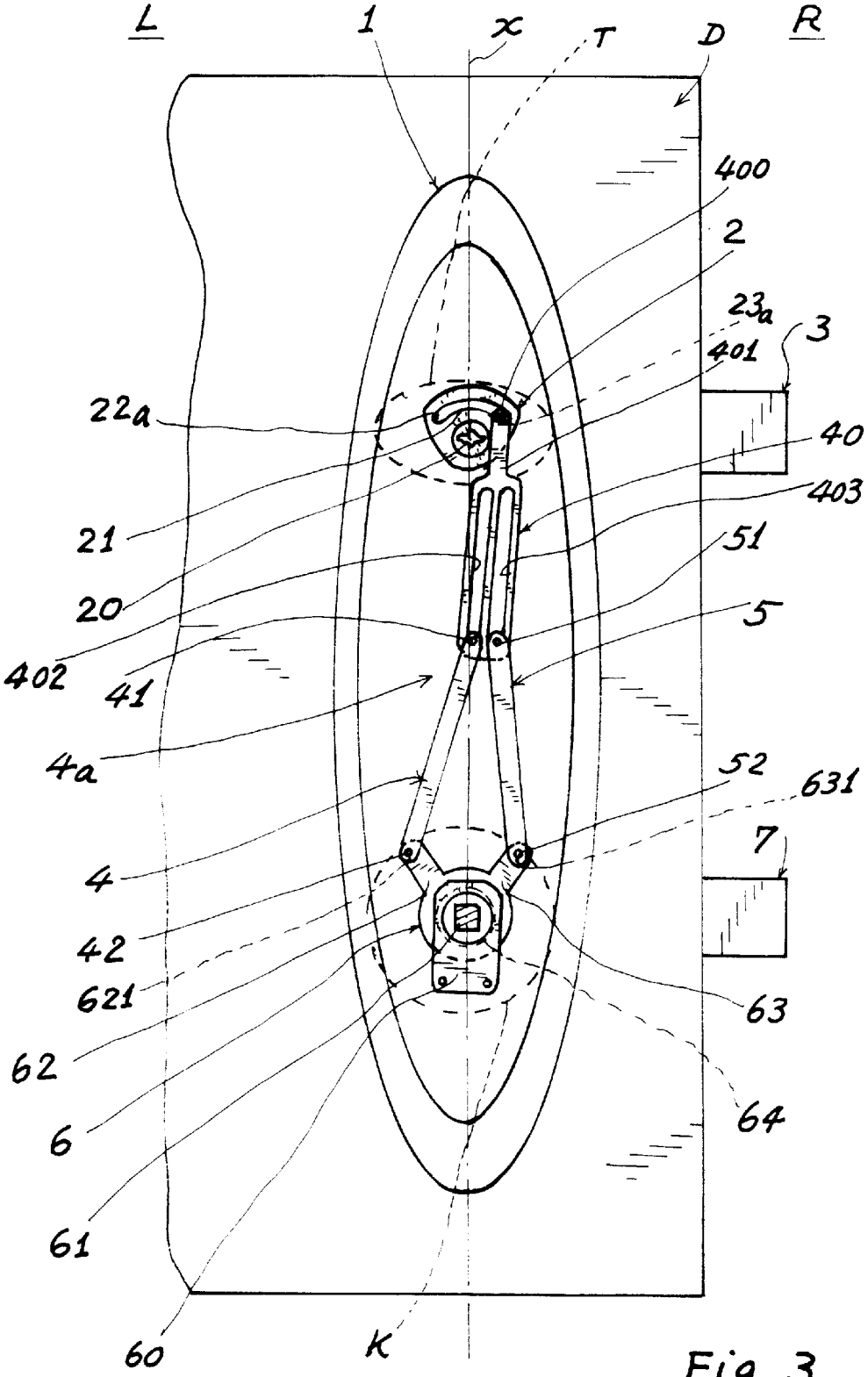
FIG. 3 is an illustration of the present invention when the latches are provided on a right side of the door.
Figure 4:
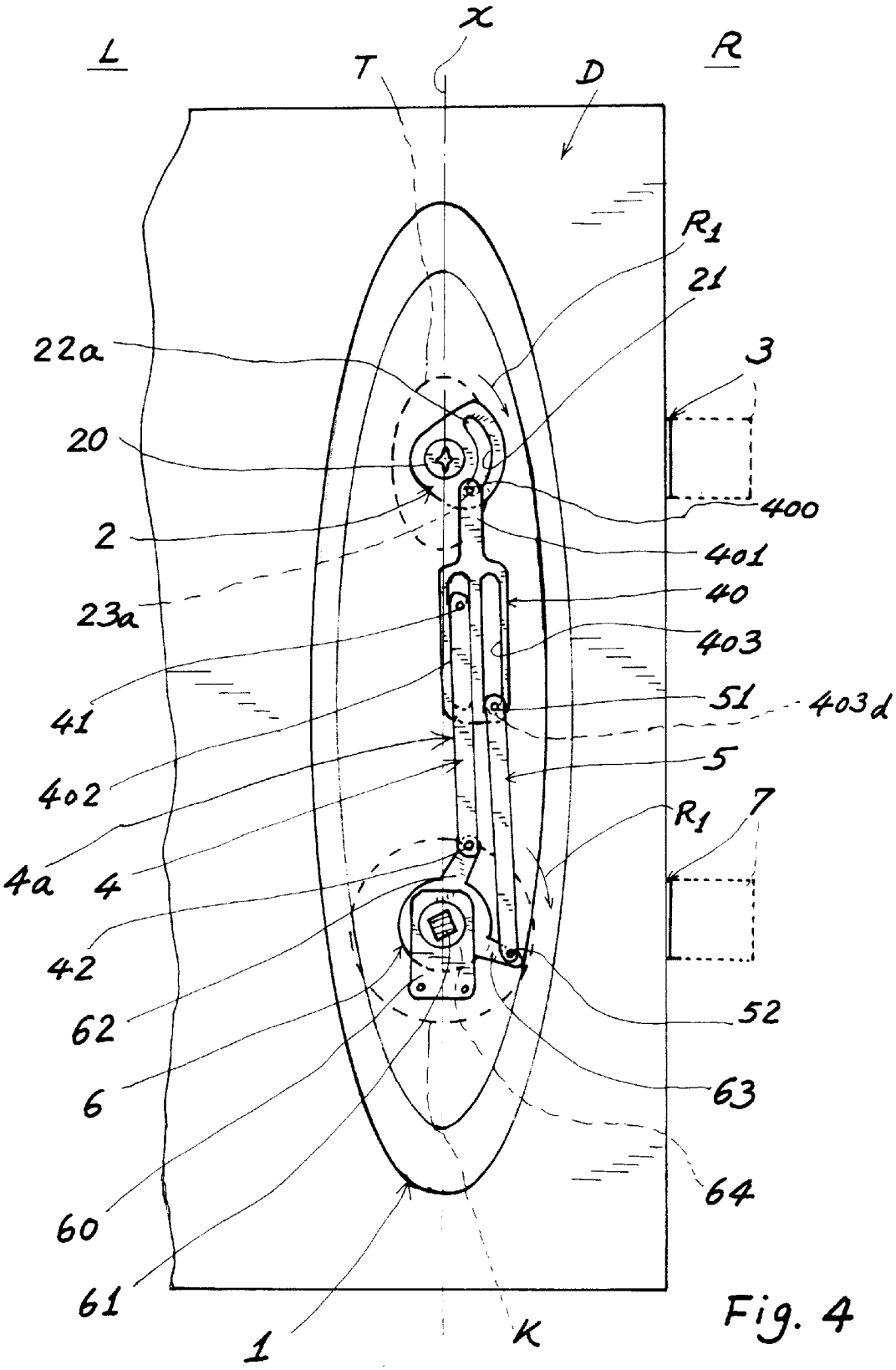
FIG. 4 shows a retraction of the latches when rotating the door knob clockwise from FIG. 3.
Figure 5:
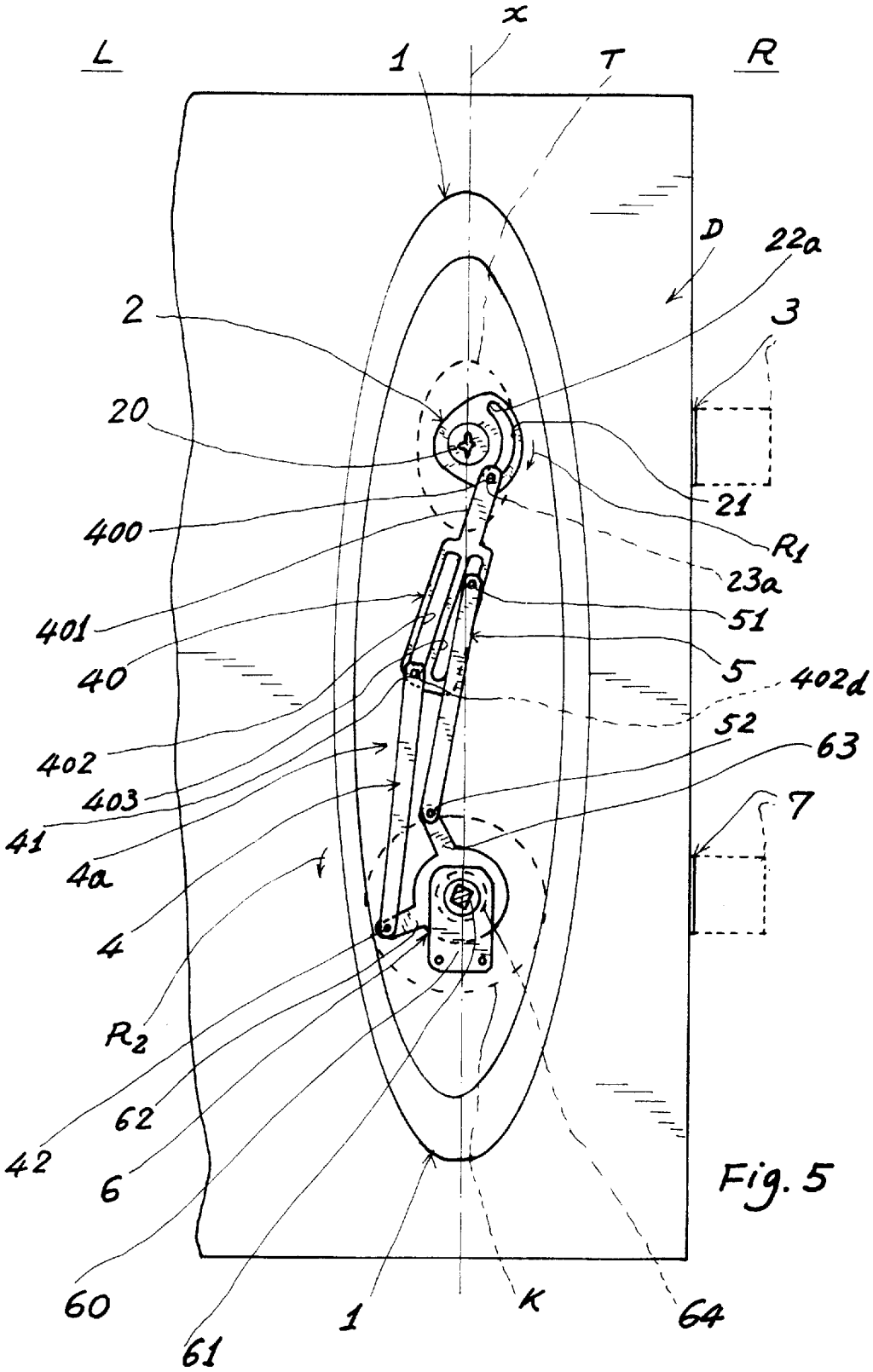
FIG. 5 shows a retraction of the latches when rotating the door knob counterclockwise from FIG. 3.

As shown in FIGS. 3~5, the door lock set of the present invention comprises: a housing 1; an upper cam 2 operatively retracting an upper latch 3 provided on an upper portion of a door D; a lower cam 6 operatively retracting a lower latch 7 provided on a lower portion of the door D; and a linking means 4*a* pivotally secured between the upper cam 2 and the lower cam 6.

The upper cam 2 includes: a spindle 20 rotatably mounted in an upper portion of the housing 1 having a thumbturn knob T coaxially secured to the spindle 20, an arcuate slot 21 arcuately formed in the upper cam 2 having a left slot end portion 22*a* formed on a left end of the arcuate slot 21 and having a right slot end portion 23*a* formed on a right end of the arcuate slot 21.

A longitudinal axis X is defined at a center of the spindle 20 of the upper cam 2 and also aligned with a center of a spindle 61 of the lower cam 6.

The shapes, angles and designs of the slot 21 and the upper cam 2 are not limited in the present invention. Each cam 2 or 6 is connected with a latch driving mechanism in order to operatively retract the latch 3 or 7, which is too conventional to be described in detail in this application.

The lower cam 6 includes a spindle 61 rotatably mounted in a holding plate 60 in a lower portion of the housing I as resiliently cushioned by a coiled spring 64 retained between the lower cam 6 and the housing 1, a left lug 62 radially protruding leftwardly from the lower cam 6 having a pin hole 621 formed in the left lug 62, and a right lug 63 radially protruding rightwardly from the lower cam 6 having a pin hole 631 formed in the right lug 63.

A door knob K is coaxially secured to the spindle 61 of the lower cam for rotating the spindle 61 and the lower cam 6 in order to retract the latches 7, 3 for opening the door.

The linking means 4*a* includes: an upper linking plate 40 having an upper stem 401 protruding upwardly from the upper linking plate 40 having a top pin 400 formed on an upper end portion of the upper stem 401 to be slidably engaging with the arcuate slot 21 in the upper cam 2, a left elongate slot 402 longitudinally formed in a left portion of the upper linking plate 40 and a right elongate slot 403 longitudinally formed in a right portion of the upper linking plate 40 juxtapositional to the left elongate slot 402; a first linking rod 4 having an upper pin 41 slidably engaging with the left elongate slot 402 of the upper linking plate 40 and having a lower pin 42 pivotally engaging with the pin hole 621 formed in the left lug 62 of the lower cam 6; and a second linking rod 5 having an upper pin 51 slidably engaging with the right elongate slot 403 of the upper linking plate 40 and having a lower pin 52 pivotally engaging with the pin hole 631 formed in the right lug 63 of the lower cam 6.

Upon disposing of the linking means 4*a* at a right side of the upper cam 2 about the longitudinal axis X as shown in FIG. 3 to engage the top pin 400 with the right slot end portion 23*a* of the arcuate slot 21 of the upper cam 2 and providing the latches 3, 7 at a right side R of the door D, the knob K (dotted line) may be rotated clockwise R1 as shown in FIG. 4 to retract the lower latch 7 and to allow the right lug 63 to pull the second linking rod 5 downwardly (from FIG. 3 to FIG. 4) until the upper pin 51 of the second linking rod 5 engaging with a lower end portion 403*d* of the right elongate slot 403 and the second linking rod 5, at this time, will pull the upper linking plate 40 and upper stem 401 downwardly to rotate the upper cam 2 and the spindle 20 of the upper cam 2 clockwise RI to retract the upper latch 3, thereby opening the door D.

Upon disposing of the linking means 4*a* at a left side of the upper cam 2 about the longitudinal axis X as shown in FIG. 3 to engage the top pin 400 with the right slot end portion 23*a* of the arcuate slot 21 of the upper cam 2 and providing the latches 3, 7 at a right side R of the door D, the knob K (dotted line) may be rotated counter clockwise R2 as shown in FIG. 5 to retract the lower latch 7 and to allow the left lug 62 to pull the first linking rod 4 downwardly (from FIG. 3 to FIG. 5) until the upper pin 41 of the first linking rod 4 engaging with a lower end portion 402*d* of the left elongate slot 402 and the first linking rod 4, at this time, will pull the upper linking plate 40 and upper stem 401 downwardly to rotate the upper cam 2 and the spindle 20 of the upper cam 2 clockwise R1 to retract the upper latch 3, thereby also opening the door D.

Accordingly, the present invention may be used for a door-knob type lock set in order to retract the latches 7, 3 either clockwise R1 (FIG. 4) or counterclockwise R2 (FIG. 5) to open the door having the latches 3, 7 provided at a right side R of the door.

Figure 6:
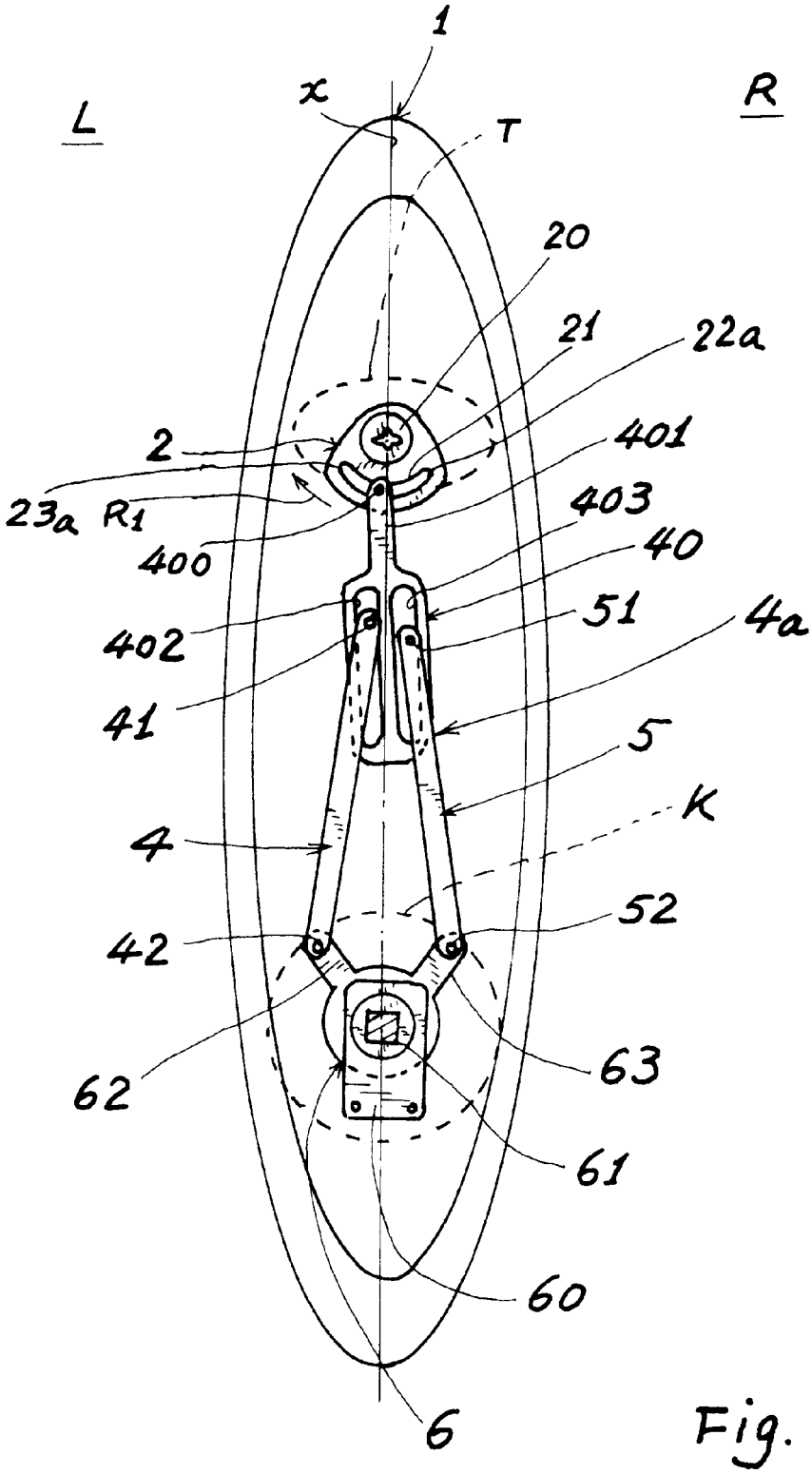
FIG. 6 shows a rotation of the upper cam in order to shift the position of the linking means from a right side (FIG. 3) of the upper cam to a left side (FIG. 7) of the upper cam.
Figure 7:
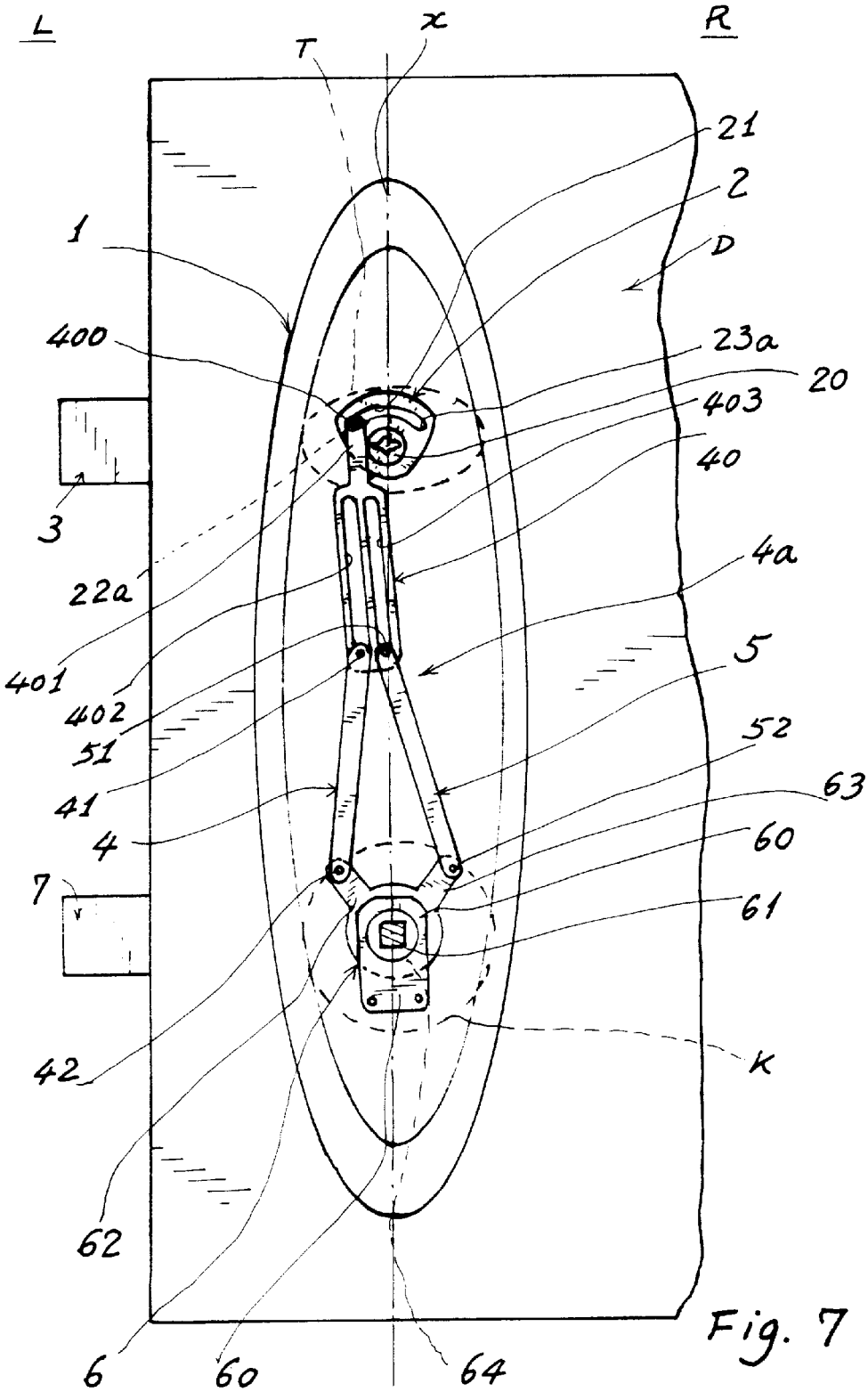
FIG. 7 shows the latches being provided on a left side of the door.
Figure 8:
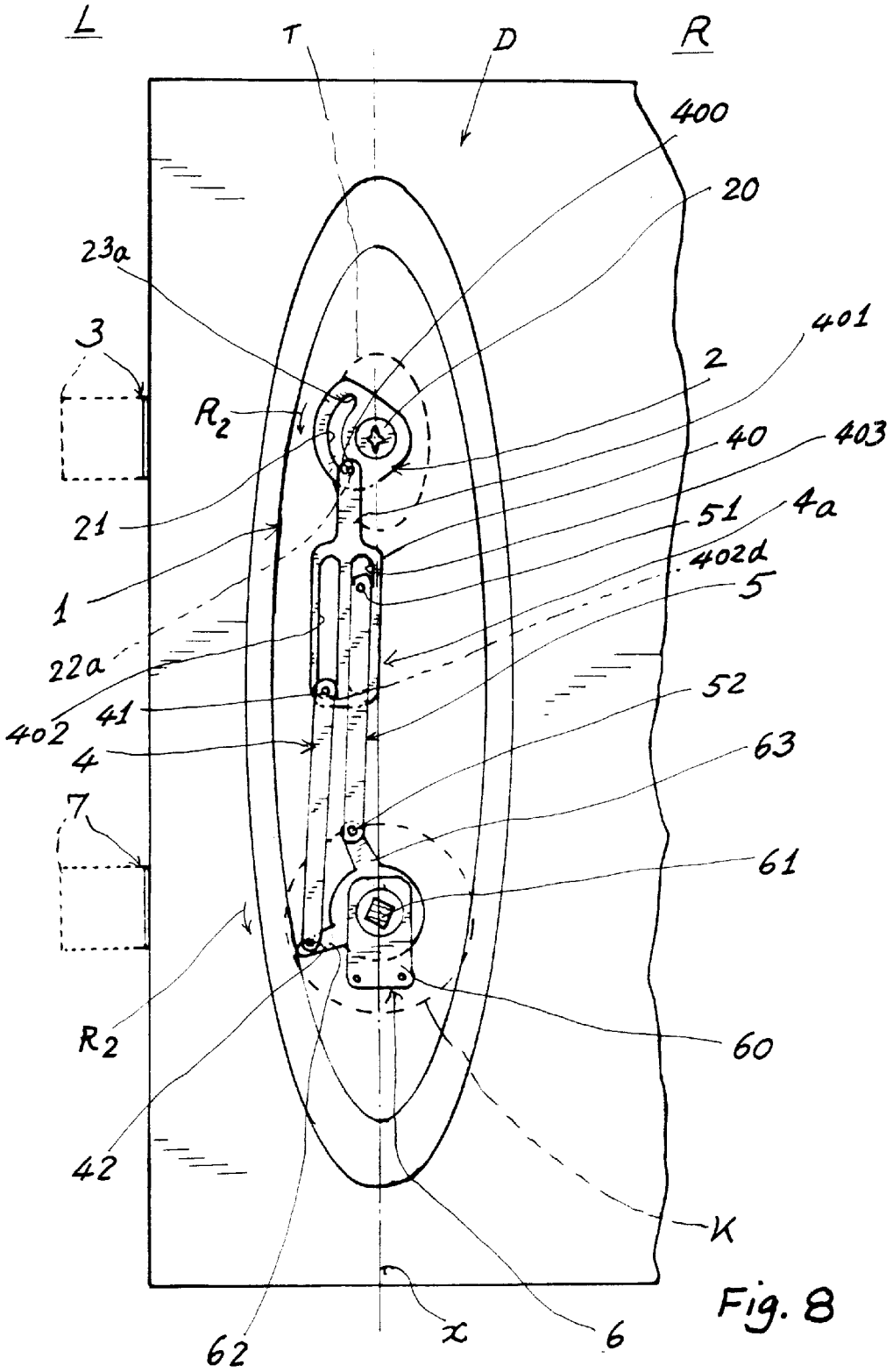
FIG. 8 shows a retraction of the latches when rotating the door knob counterclockwise from FIG. 7.
Figure 9:
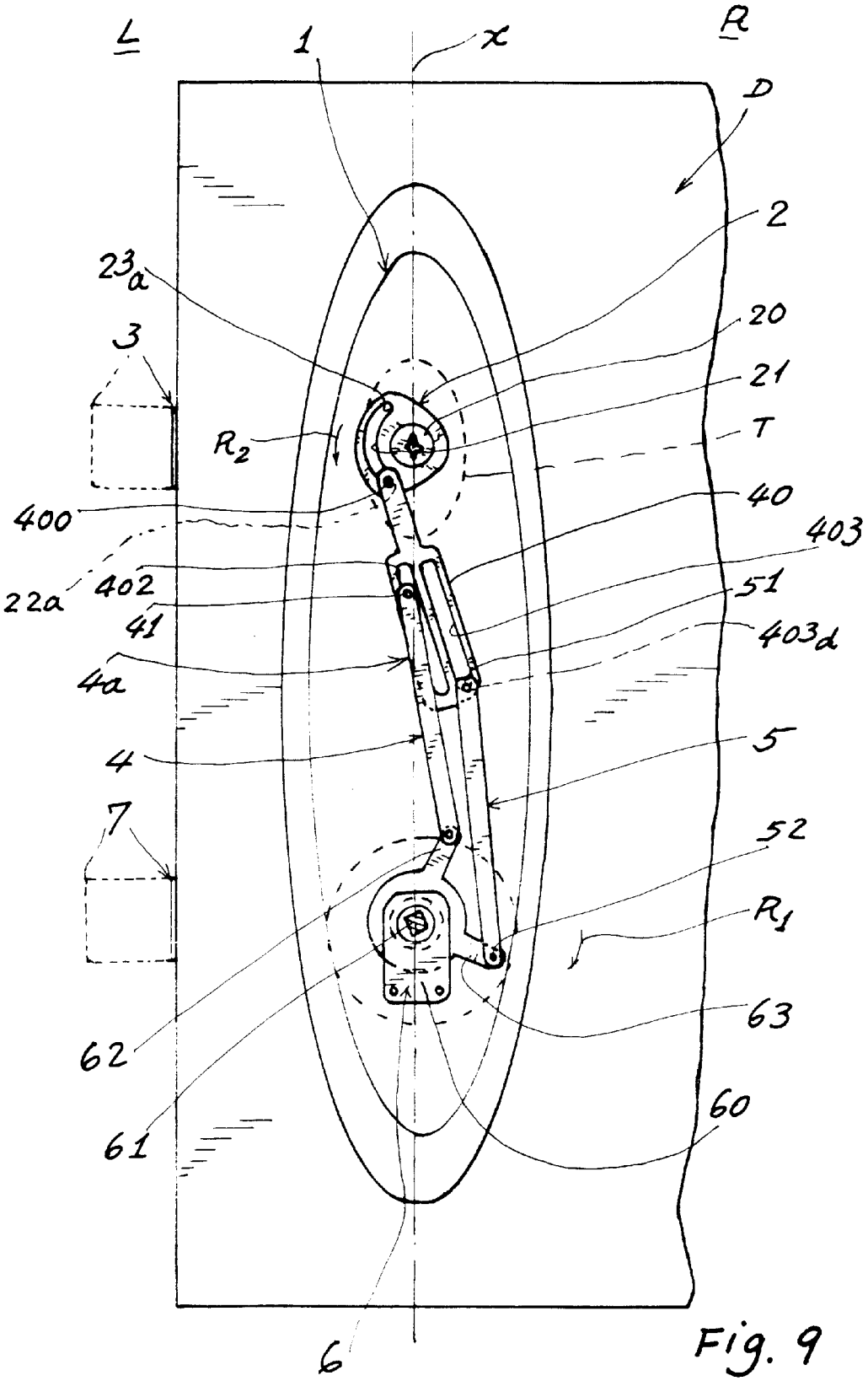
FIG. 9 shows a retraction of the latches when rotating the door knob clockwise from FIG. 7.

For use in a door D by providing the latches 3, 7 at a left side L of the door as shown in FIGS. 7~9, the thumbturn knob T may be rotated clockwise R1 as shown in FIG. 6 to shift the position of the linking means 4*a* from the right side of the upper cam 2 as shown in FIG. 3 towards the left side of the cam 2 about the longitudinal axis X as shown in FIG. 7.

The linking means 4*a* is now disposed at a left side of the cam 2 to engage the top pin 400 with the left slot end portion 22*a*. The knob K may be rotated counterclockwise R2 as shown in FIG. 8 to retract the lower latch 7 and to allow the left lug 62 to pull the first linking rod 4 downwardly (from FIG. 7 to FIG. 8) until the upper pin 41 of the first linking rod 4 engaging with a lower end portion 402*d* of the left elongate slot 402 and the first linking rod 4, at this time, will pull the upper linking plate 40 and upper stem 401 downwardly to rotate the upper cam 2 and the spindle 20 of the upper cam 2 counter clockwise R2 to retract the upper latch 3, thereby opening the door D.

From FIG. 7 to FIG. 9, the knob K may be rotated clockwise R1 as shown in FIG. 9 to retract the lower latch 7 and to allow the right lug 63 to pull the second linking rod 5 downwardly until the upper pin 51 of the second linking rod 5 engaging with a lower end portion 403*d* of the right elongate slot 403 and the second linking rod 5, at this time, will pull the upper linking plate 40 and upper stem 401 downwardly to rotate the upper cam 2 and the spindle 20 of the upper cam 2 counter clockwise R2 to retract the upper latch 3, thereby also opening the door D.

Since the linking means 4*a* (especially the upper stem 401 of the upper linking plate 40) may be conveniently disposed at either right side of the upper cam 2 or left side of the cam 2 just by rotating the thumbturn T or cam 2 from FIG. 3 through FIG. 6 to FIG. 7; or vice versa from FIG. 7 to FIG. 3, the present invention is superior to and improved over the prior application of U.S. Ser. No. 09/667,640.

Meanwhile, the upper stem 401 of the upper linking plate 40 is a single stem or plate optionally disposed at a right side of the cam 2 or at a left side of the cam 2, not the two linking rods 4, 5 disposed on both right and left sides of the cam as disclosed in the prior application, so that the rotating angle of the lower cam 6 and the knob K will become larger or wider to be suitable for use in the door-knob type lock set.

The present invention may be modified without departing from the spirit and scope of the present invention.

I claim:

1. A door lock set comprising:

a housing (1) fixed on a door; having an upper latch (3) and a lower latch (7) respectively formed in an upper portion and a lower portion of said door;

an upper cam (2) including: a spindle (20) rotatably mounted in an upper portion of the housing (1) having a thumbturn knob (T) coaxially secured to the spindle (20) for operatively retracting said upper latch (3) for opening the door, an arcuate slot (21) arcuately formed in the upper cam (2) having a left slot end portion (22*a*) formed on a left end of the arcuate slot (21) and having a right slot end portion (23*a*) formed on a right end of the arcuate slot (21); and having a longitudinal axis (X) defined at a center of the spindle (20) of the upper cam (2); whereby upon a rotation of said thumbturn knob (T) and said upper cam (2), said upper latch (3) will be retracted into the door for opening the door;

a lower cam (6) including a spindle (61) rotatably mounted in a holding plate (60) in a lower portion of the housing (1) for operatively retracting said lower latch (7) for opening the door, having said longitudinal axis (X) aligned with a center of said spindle (61), a left lug (62) radially protruding leftwardly from the lower cam (6), and a right lug (63) radially protruding rightwardly from the lower cam (6); and having a door knob (K) coaxially secured to the spindle (61) of the lower cam (6) for rotating the spindle (61) and the lower cam (6) in order to retract the lower latch (7) for opening the door; and a linking means (4*a*) including: an upper linking plate (40) having an upper stem (401) protruding upwardly from the upper linking plate (40) having a top pin (400) formed on an upper end portion of the upper stem (401)

to be slidably engaging with the arcuate slot (21) in the upper cam (2), with said top pin (400) limited at said left slot end portion (22*a*) or limited at said right slot end portion (23*a*) when rotating said upper cam (2) as downwardly pulled by said linking means (4*a*), a left elongate slot (402) longitudinally formed in a left portion of the upper linking plate (40) and a right elongate slot (403) longitudinally formed in a right portion of the upper linking plate (40) juxtapositional to the left elongate slot (402); a first linking rod (4) having an upper pin (41) slidably engaging with the left elongate slot (402) of the upper linking plate (40) and having a lower pin (42) pivotally engaging with a pin hole (621) in the left lug (62) of the lower cam (6); and a second linking rod (5) having an upper pin (51) slidably engaging with the right elongate slot (403) of the upper linking plate (40) and having a lower pin (52) pivotally engaging with a pin hole (631) in the right lug (63) of the lower cam (6); whereby upon a rotation of said upper cam (2), said linking means (4*a*) will be shifted from a right side of said upper cam (2) about said longitudinal axis (X) to a left side of said upper cam (2), and vice versa; and upon either a clockwise or counterclockwise rotation of said door knob (K) and said lower cam (6), said lower latch (7) will be retracted, and said upper cam (2) will be simultaneously rotated as downwardly pulled by said linking means (4*a*) to retract said upper latch (3) for opening the door.

* * * * *